US008991932B2

(12) United States Patent
Okuda et al.

(10) Patent No.: US 8,991,932 B2
(45) Date of Patent: Mar. 31, 2015

(54) BACKREST MECHANISM FOR CHAIR

(75) Inventors: Naoyuki Okuda, Kanagawa (JP); Syouichi Izawa, Kanagawa (JP)

(73) Assignee: Okamura Corporation, Yokohama-Shi, Kanagawa (JP)

( * ) Notice: Subject to any disclaimer, the term of this patent is extended or adjusted under 35 U.S.C. 154(b) by 0 days.

(21) Appl. No.: 14/116,992

(22) PCT Filed: May 11, 2011

(86) PCT No.: PCT/JP2011/060883
§ 371 (c)(1),
(2), (4) Date: Nov. 21, 2013

(87) PCT Pub. No.: WO2012/153408
PCT Pub. Date: Nov. 15, 2012

(65) Prior Publication Data

US 2014/0077574 A1 Mar. 20, 2014

(30) Foreign Application Priority Data

Nov. 12, 2009 (JP) ..... 2009-258539

(51) Int. Cl.
*A47C 7/02* (2006.01)
*A47C 7/44* (2006.01)

(52) U.S. Cl.
CPC ..... *A47C 7/44* (2013.01)
USPC ..... 297/452.31

(58) Field of Classification Search
USPC ..... 297/452.31, 452.3, 452.15, 451.11, 297/445.1
See application file for complete search history.

(56) References Cited

U.S. PATENT DOCUMENTS

| | | | | |
|---|---|---|---|---|
| 6,257,665 | B1 * | 7/2001 | Nagamitsu et al. | 297/285 |
| 6,626,497 | B2 * | 9/2003 | Nagamitsu et al. | 297/452.15 |
| 7,686,395 | B2 * | 3/2010 | Piretti | 297/297 |
| 7,857,388 | B2 * | 12/2010 | Bedford et al. | 297/284.7 |
| 7,878,598 | B2 * | 2/2011 | Oda | 297/452.15 |
| 7,971,935 | B2 * | 7/2011 | Saez et al. | 297/285 |
| 8,191,970 | B2 * | 6/2012 | Igarashi et al. | 297/452.15 |

FOREIGN PATENT DOCUMENTS

| | | | |
|---|---|---|---|
| JP | 2008-237333 | A | 10/2008 |
| JP | 4238122 | A | 3/2009 |
| JP | 2009-112397 | A | 5/2009 |

(Continued)

OTHER PUBLICATIONS

International Search Report PCT/JP2011/060883 dated Jun. 14, 2011.

(Continued)

*Primary Examiner* — Milton Nelson, Jr.
(74) *Attorney, Agent, or Firm* — McDermott Will & Emery LLP

(57) ABSTRACT

A backrest mechanism for a chair includes a pair of left and right side rods, each having a folded portion in a laid-V shape in a side view at a portion for supporting a sitting person around his or her lumbar, and a back plate that connects opposing surfaces of the side rods. An upper portion of the back plate above the folded portions serves as a flexible portion that is elastically deformable in a backward direction and that has smaller rigidity than the left and right side rods, and a lower portion of the back plate below the flexible portion serves as an inflexible portion that has greater rigidity than the flexible portion.

5 Claims, 9 Drawing Sheets

(56) References Cited

FOREIGN PATENT DOCUMENTS

| | | | |
|---|---|---|---|
| JP | 2009-112729 | A | 5/2009 |
| JP | 4295266 | A | 7/2009 |
| JP | 2009-195742 | A | 9/2009 |
| JP | 2011-083527 | A | 4/2011 |
| JP | 2011-101762 | A | 5/2011 |

OTHER PUBLICATIONS

Supplementary European Search Report EP Application No. 11864921.9 dated Aug. 27, 2014.

* cited by examiner

BACKREST MECHANISM FOR CHAIR

CROSS REFERENCE TO RELATED APPLICATIONS

This application is the U.S. National Phase of PCT/JP2011/060883 filed May 11, 2011, and is related to Japanese Patent Application No. 2009-258539 filed Nov. 12, 2009 each of which is incorporated by reference herewith.

FIELD

The present invention relates to a backrest mechanism for a chair, in which opposing surfaces of left and right side rods of a backrest are connected via a back plate.

BACKGROUND

A certain backrest among backrests for office chairs is configured such that, for example, the entire backrest is integrally formed with synthetic resin and a plurality of openings are formed in a back plate for back support, so that the back plate can appropriately bend backward to provide a comfortable sitting feeling when a person leans on the backrest (see, for example, Patent Literatures 1 to 3).

CITATION LIST

Patent Literature

Patent Literature 1: Japanese Patent Application Laid-open No. 2009-112729

Patent Literature 2: Japanese Patent No. 4295266

Patent Literature 2: Japanese Patent No. 4238122

SUMMARY

Technical Problem

In each of the backrests for chairs disclosed in Patent Literatures 1 to 3 as described above, a flexible back plate is provided on the inside surrounded by a back casing (back frame) that has large rigidity and a rectangular shape when viewed from the front. Therefore, if the backrest is reclined and the upper body is largely leaned back, a lateral casing oriented in the left-right direction in the upper end of the back casing prevents an upper portion of the back plate from bending backward, so that the upper back cannot be supported comfortably.

Furthermore, a certain chair among the chairs disclosed in Patent Literatures as described above is configured such that an intermediate portion of the back frame and the back plate in the up-down direction is folded in a laid-V shape when viewed from the side to provide comfortable support around lumbar by the lumbar support effect. However, the lumbar support effect is reduced in a lower portion of the back plate because almost the entire surface of the back plate surrounded by the back casing is made flexible.

The present invention has been made in view of the above circumstances, and an object thereof is to provide a backrest mechanism for a chair, in which upper and lower portions of a back plate are distinctly separated as a flexible portion and an inflexible portion in order to give a sitting person comfortable support at and around his or her back and lumbar.

Solution to Problem

According to the present invention, the above object is accomplished by the following aspects.

(1) A backrest includes a pair of left and right side rods, each having a folded portion in a laid-V shape in a side view at a portion for supporting a sitting person around his or her lumbar; and a back plate that connects opposing surfaces of the side rods, wherein an upper portion of the back plate above the folded portions serves as a flexible portion that is elastically deformable in a backward direction and that has smaller rigidity than the left and right side rods, and a lower portion of the back plate below the flexible portion serves as an inflexible portion that has greater rigidity than the flexible portion.

According to the above-described configuration, the back plate is distinctly separated into the upper flexible portion and the lower inflexible portion across the folded portions of the side rods, and the upper flexible portion, which is located above the folded portions of the side rods and which supports the back of a sitting person, is connected to the opposing surfaces of the pair of the left and right side rods that have greater rigidity than the upper flexible portion, unlike a conventional configuration in which the upper end of the flexible portion is surrounded by a back frame. Therefore, when the backrest is reclined, the flexible portion effectively bends backward and provides comfortable back support.

In contrast, the lower portion of the back plate below the flexible portion serves as the inflexible portion with greater rigidity than the flexible portion, and is less likely to bend backward. Therefore, the lumbar support effect is exerted and a sitting person can be supported comfortably around his or her lumbar.

(2) In the above-described aspect (1), a center portion of the inflexible portion in a left-right direction is connected to a backrest support rod that stands upward at a rear of a seat.

According to the above-described configuration, the center portion in the left-right direction of the inflexible portion with large rigidity is connected to the backrest support rod. Therefore, the flexible portion that is not connected to the backrest support rod can more easily bend backward in more upper portions, so that it becomes possible to comfortably support the back.

(3) In the above-described aspect (1) or (2), a plurality of elongated holes elongated in an up-down direction and arranged in up-down and left-right directions are provided in the flexible portion.

According to the above-described configuration, it becomes possible to bend the flexible portion in a backward convex arc shape in a planer view, about the elongated holes that are arranged in the up-down and the left-right directions, so that the flexible portion can fit the back.

(4) In the above-described aspect (1), the flexible portion and the inflexible portion are connected to the opposing surfaces of the left and right side rods such that the flexible portion is located anteriorly relative to the inflexible portion, a lower end of the flexible portion and an upper end of the inflexible portion are continued via a step portion, and a grid-like rib is arranged so as to protrude from a front surface of the inflexible portion and so as to be continued to the step portion.

According to the above-described configuration, the flexible portion is located anteriorly relative to the inflexible portion and the grid-like rib is arranged so as to protrude from the inflexible portion. Therefore, the bending rigidity of the inflexible portion is increased relative to that of the flexible portion and the lumbar support effect is improved, so that it becomes possible to provide comfortable support around the lumbar.

Furthermore, the lower end of the flexible portion and the upper end of the inflexible portion are continued via the step portion, and the upper end of the grid-like rib is continued to the step portion. Therefore, the strength at the boundary between the flexible portion and the inflexible portion of the back plate can hardly be reduced.

(5) In the above-described aspect (4), a front surface plate is attached to the front surface of the inflexible portion across the grid-like rib.

According to the above-described configuration, the grid-like rib can be covered by the front surface plate in a dressed-up manner, and the front surface plate can be reinforced by the grid-like rib provide on the rear surface thereof and can function as the inflexible portion with large rigidity. Therefore, it becomes possible to provide comfortable support by the front surface plate around the lumbar.

Advantageous Effects of Invention

According to the present invention, it is possible to provide a backrest mechanism for a chair, in which upper and lower portions of a back plate are distinctly separated as a flexible portion and an inflexible portion in order to give a sitting person comfortable support at and around his or her back and lumbar by the flexible portion and the inflexible portion.

DESCRIPTION OF EMBODIMENTS

Hereinafter, embodiments of the present invention will be described with reference to the drawings.

Figure 1:
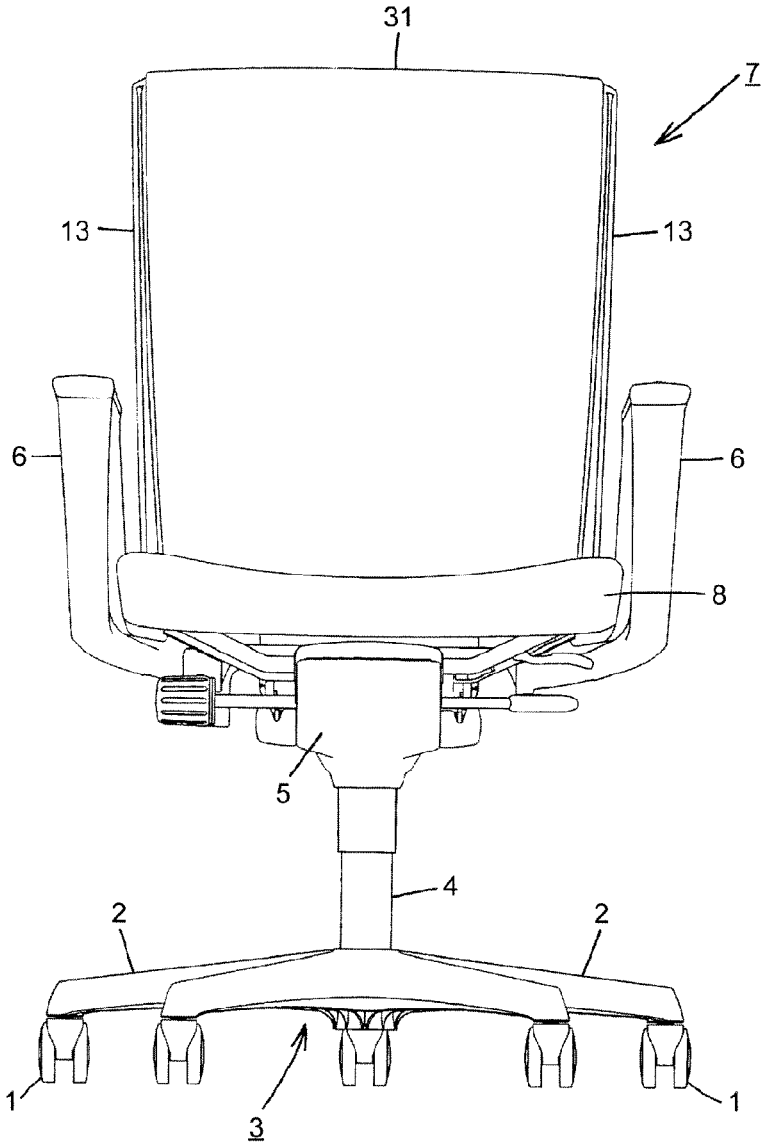
FIG. 1 is a front view of a chair provided with an embodiment of the present invention.
Figure 2:
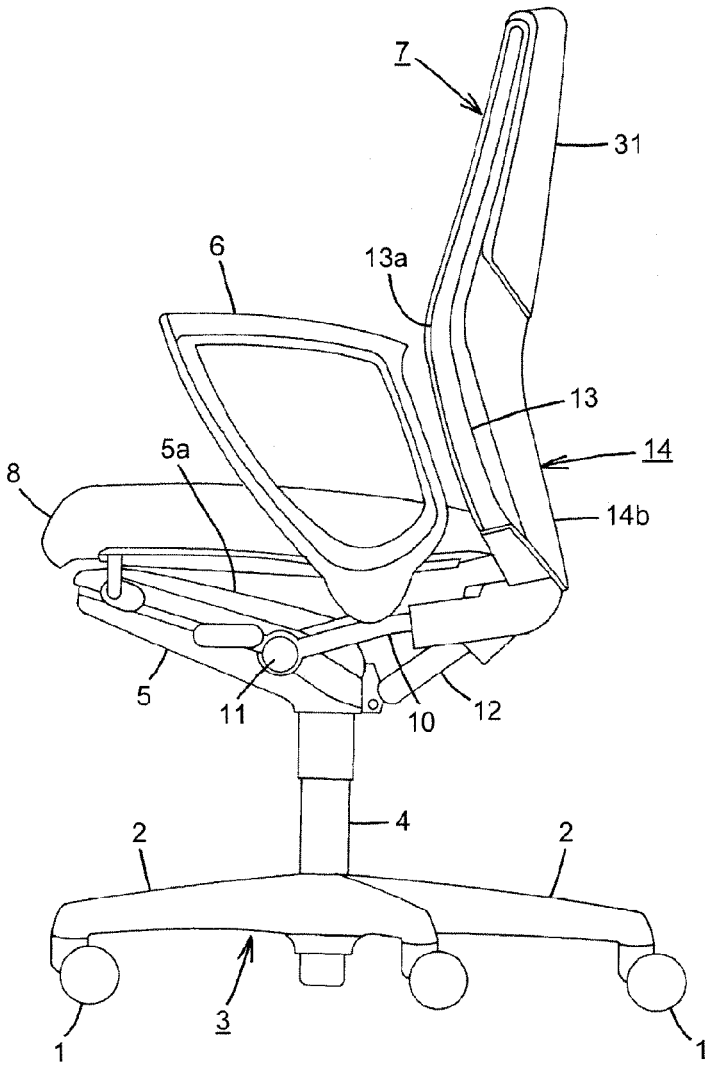
FIG. 2 is a side view of the embodiment.
Figure 3:
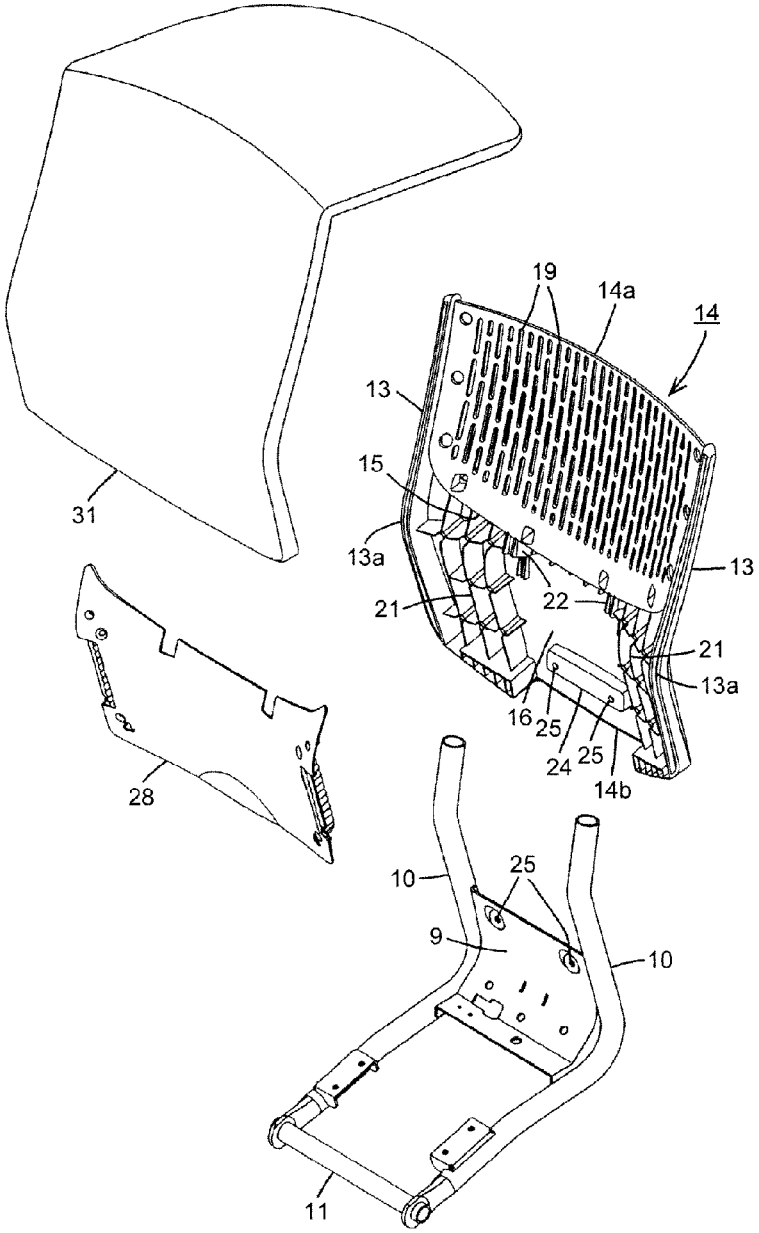
FIG. 3 is an exploded perspective view of backrest support rods and a backrest mounted on the backrest support rods of the embodiment.

FIG. 1 is a front view of a chair provided with an embodiment of the present invention, FIG. 2 is a side view of the embodiment, and FIG. 3 is an exploded perspective view of main components of the embodiment. The chair includes a leg body 3 having radial five leg rods 2, each having a caster 1 at a leading end thereof. A retractable leg column 4 that includes a gas spring (not illustrated) is vertically installed in the center of the leg body 3, and a rear portion of a support base 5 is fixedly mounted on an upper end of the leg column 4.

The support base 5 has a substantially hollow box shape with an upper surface open, and an opening of the upper surface is covered by a detachable cover 5*a*. A pair of left and right armrests 6 and 6 are mounted on both side surfaces of the support base 5.

While a biasing means configured to bias a backrest 7 in a standing direction, i.e., a forward direction, and a biasing means configured to bias a seat supported by the support base 5 in the forward direction (neither illustrated) are installed in the support base 5, these are not directly related to the present invention, and therefore, illustration and detailed description thereof will be omitted.

The backrest 7 is configured such that opposing surfaces at an intermediate curved portion are connected via a connecting plate 9 that is oriented in the left-right direction, and an upper half is mounted on a pair of left and right backrest support rods 10 and 10 that stand upward at the rear of the seat 8 and that has an L-shape when viewed from the side (details will be described later).

Front ends of the left and right backrest support rods 10 and 10 are pivotally mounted on the support base 5 via a left-right directional shaft 11, and the backrest support rods 10 and 10 and the backrest 7 can rotate in a front-back direction about the shaft 11 or can stop at a predetermined backward-tilt angle by the operation of a gas spring 12 whose front and rear ends are connected to a rear end of the support base 5 and the connecting plate 9.

The backrest 7 includes a pair of left and right side rods 13 and 13, which are folded in a laid-V shape in a side view at intermediate portions in the up-down direction, that is, portions at a height near the lumbar of a sitting person, and a back plate 14 that connects opposing surfaces of both of the side rods 13 and that has a smaller thickness than a front-back dimension of each of the side rods 13. A left-right dimension and the front-back dimension of the left and right side rods 13 and 13 are gradually reduced in the upward direction. Incidentally, the left and right side rods 13 and 13 and the back plate 14 are integrally formed with synthetic resin.

Figure 7:
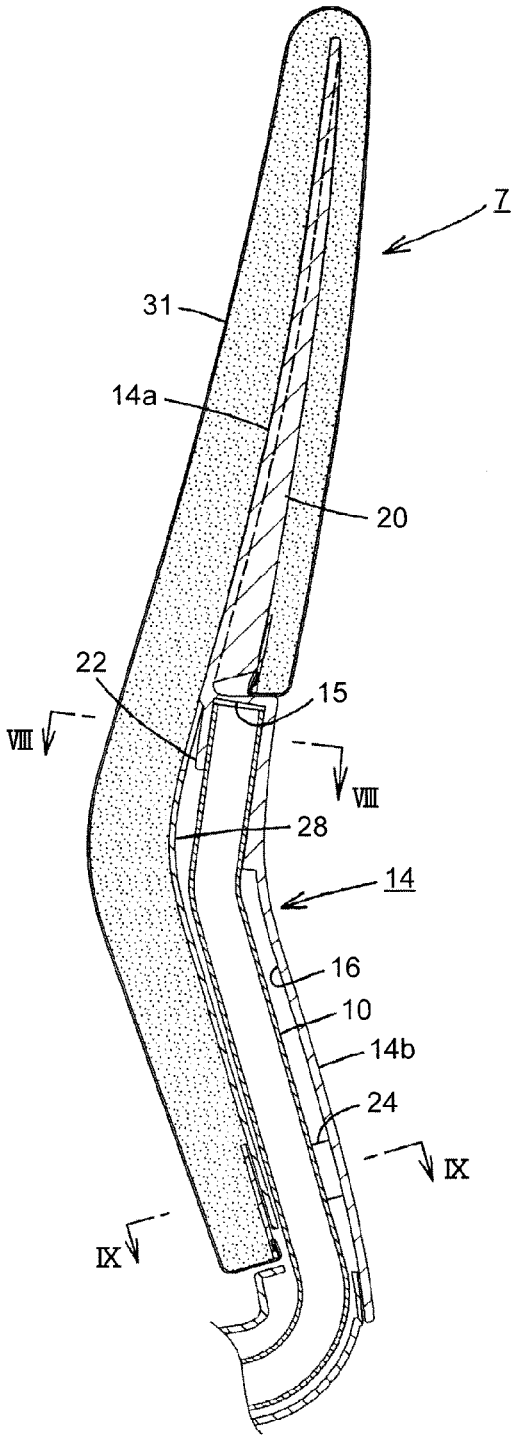
FIG. 7 is an enlarged longitudinal cross-sectional side view of a mounting portion of the backrest on the backrest support rods.

A portion of the back plate 14 for supporting the back of a sitting person, that is, a portion slightly above folded portions 13*a* of the side rods 13 serves as a flexible portion 14*a*, and a lower half for supporting a portion around and below the lumbar of the sitting person serves as an inflexible portion 14*b*. The flexible portion 14*a* is formed at the intermediate portions of the opposing surfaces of both of the side rods 13 and the inflexible portion 14*b* is formed at rear edges of both of the side rods 13 in a continuous manner, so that a step portion 15 that is recessed backward and that has a horizontal cross-section is formed at an intermediate portion being a connection portion of the flexible portion and the inflexible portion in the up-down direction (see FIG. 7). Furthermore, a concave portion 16 that is recessed backward and opened downward is formed on the front surface of the back plate 14 below the step portion 15 because the front surface of the inflexible portion 14*b* is located posteriorly relative to the front surface of the flexible portion 14*a*.

A lower edge of the flexible portion 14*a* and a lower surface of the step portion 15 are curved, in a downward arc shape, toward the vicinity of the folded portions 13*a* of the side rods 13.

A pair of front and rear concave grooves 17 and 18, the former of which is recessed backward, the latter of which is recessed forward, and both of which are oriented in the up-down direction, are respectively formed in front and rear surfaces of each of the left and right side rods 13 and 13 such that the grooves are aligned in the front-back direction. A horizontal cross-section of a portion of each of the side rods 13 in which the concave grooves 17 and 18 are provided has a substantially H-shape (see FIG. 5). The concave grooves 17 and 18 are used to mount a not-shown optional member on the backrest 7.

Figure 4:
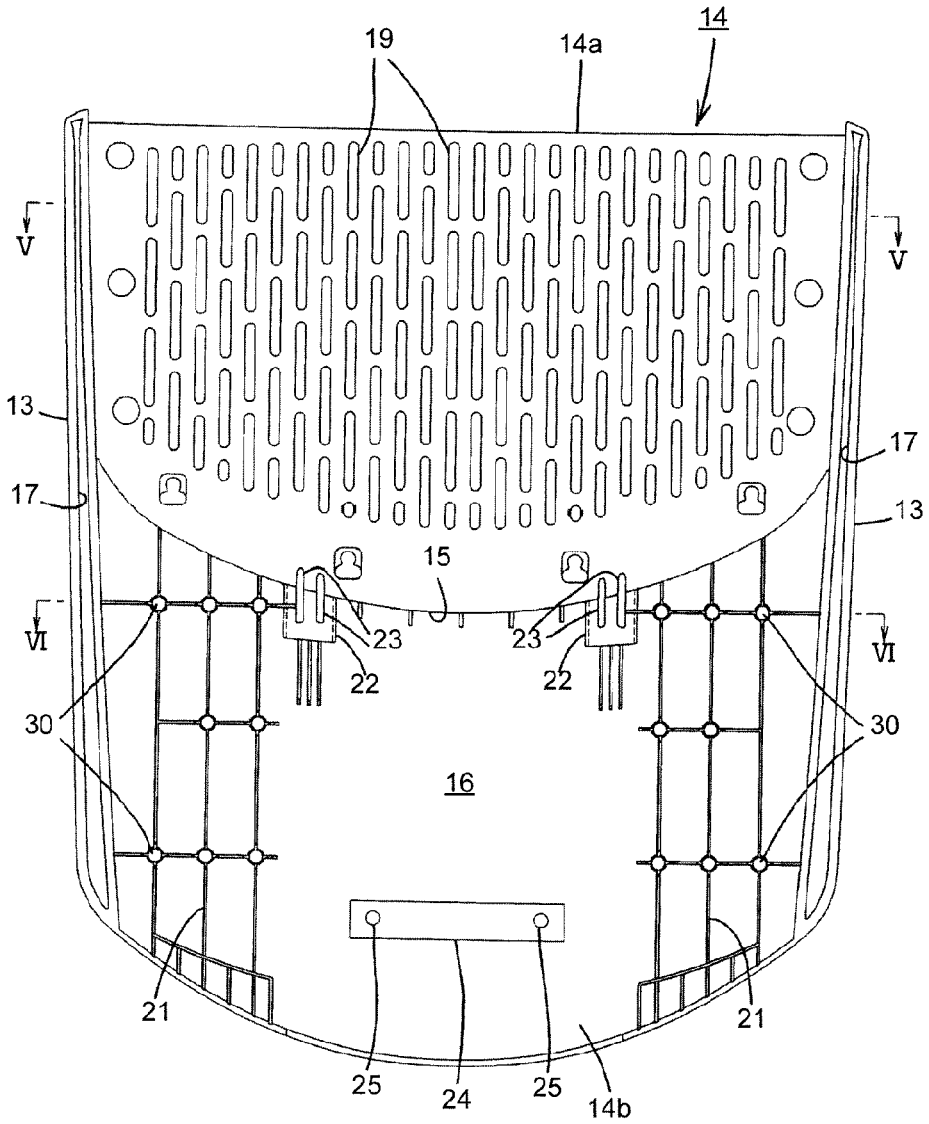
FIG. 4 is front view of a back plate of the embodiment.
Figure 5:
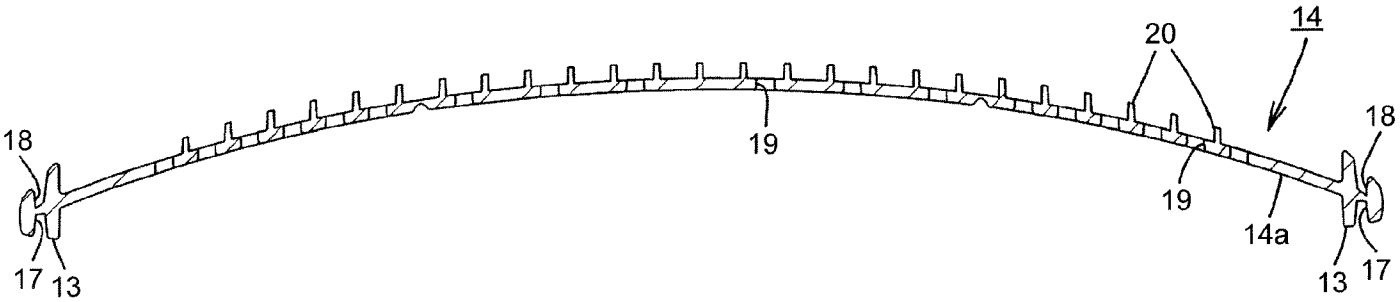
FIG. 5 is an enlarged transverse cross-sectional plan view taken along line V-V of FIG. 4.
Figure 6:
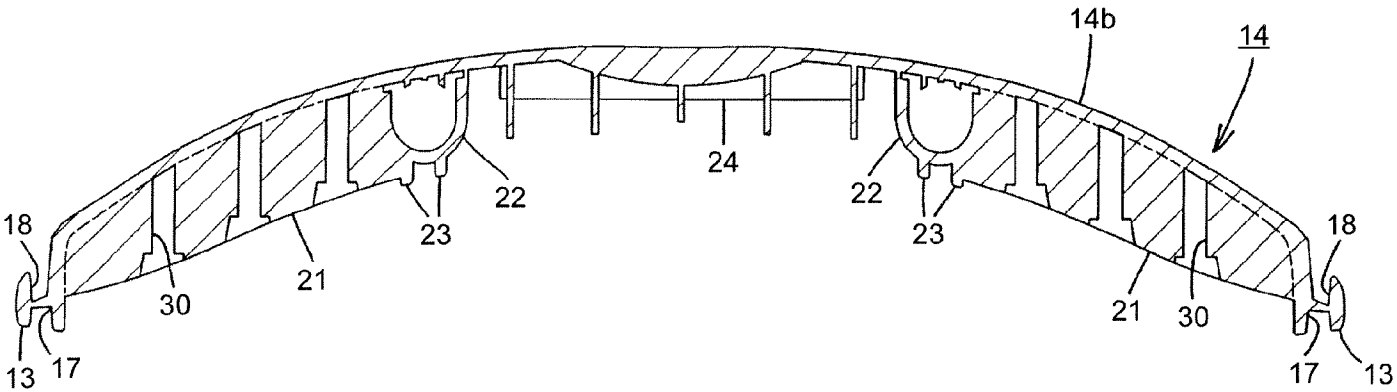
FIG. 6 is an enlarged transverse cross-sectional plan view taken along line VI-VI of FIG. 4.

As illustrated in enlarged views in FIG. 4 and FIG. 5, a plurality of elongated holes 19 elongated in the up-down direction and arranged in the up-down and the left-right directions are provided in almost the entire surface of the flexible portion 14*a* of the back plate 14 except for the lower end portion, such that the elongated holes are arranged adjacent to each other in a zigzag manner in the left-right direction. This makes the flexible portion 14*a* to easily bend in a backward convex arc shape when viewed in the planer view, about the elongated holes 19 arranged in the up-down direction, so that the back of a sitting person can be supported comfortably. A plurality of ribs 20 that are oriented in the up-down direction are arranged so as to protrude from the rear surface of the flexible portion 14*a*, so that the bending rigidity of the flexible portion 14*a* in a direction perpendicular to the elongated holes 19 increases. Incidentally, the thickness of the flexible portion 14*a* is approximately uniform, and only the front-back dimensions of the ribs 20 are gradually reduced in the upward direction (see FIG. 7).

Grid-like ribs 21, upper ends of which are continued to the step portion 15, are arranged so as to protrude from both sides of the front surface of the inflexible portion 14*b* of the back plate 14, and the bending rigidity of the inflexible portion 14*b* is made greater than the bending rigidity of the flexible portion 14*a*, so that a portion for supporting a sitting person around and below his or her lumbar becomes less likely to bend backward. Incidentally, a front surface plate 28 made of synthetic resin, which will be described later, is attached to the front surface of the inflexible portion 14*b*. The front surface plate 28 is attached across the ribs 21, so that the front surface plate has a function as the inflexible portion for supporting a sitting person around his or her lumbar.

As illustrated in FIG. 4 and FIG. 6 to FIG. 8, tubular holding portions 22 and 22, which can hold the backrest 7 while determining the positions of the upper ends of the left and right backrest support rods 10 and which are opened downward, are integrally formed so as to protrude downward from the lower surfaces of both sides of the step portion 15 of the back plate 14. The rear surface and a part of the lateral outer surface of each of the holding portions 22 are respectively connected to the front surface of the inflexible portion 14*b* and a horizontal piece of each of the grid-like ribs 21, and the front outer surface of each of the holding portions 22 and the lower front surface of the flexible portion 14*a* are connected to each other via vertical ribs 23 and 23, so that the left and right holding portions 22 and 22 are reinforced.

To mount the backrest 7 on the left and right backrest support rods 10 and 10, first, the left and right holding portions 22 and 22 protruding from the lower surface of the step portion 15 of the back plate 14 are fitted, from above, to the upper ends of the left and right backrest support rods 10 and 10 that are inserted in the concave portion 16 between the left and right grid-like ribs 21 and 21 on the front surface of the inflexible portion 14*b* of the back plate 14, so that the backrest 7 is temporarily held by the left and right backrest support rods 10 and 10.

Figure 9:
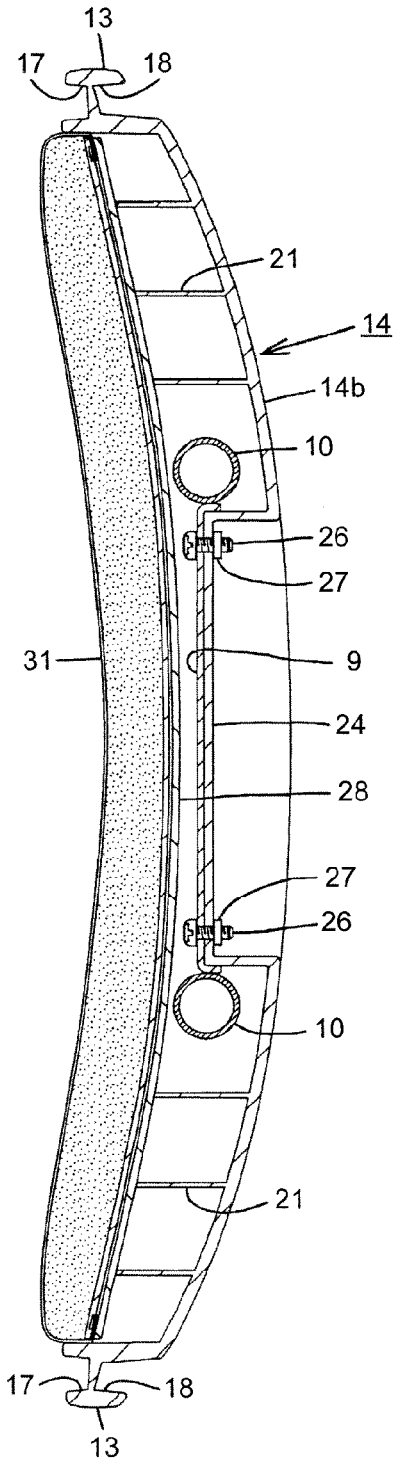
FIG. 9 is an enlarged transverse cross-sectional plan view taken along line IX-IX of FIG. 7.

Subsequently, as illustrated in FIG. 9, a front surface of a left-right directional fixing piece 24 protruding forward from the center portion of the lower front surface of the inflexible portion 14*b* of the back plate 14 is brought into contact with the rear surface of the upper end of the connecting plate 9 that is fixed to the opposing surfaces of the left and right backrest support rods 10 and 10. Subsequently, the connecting plate 9 and the fixing piece 24 are fixed with fixing screws 26 and 26 that are inserted, from the front surface side, into two left and right through holes 25 and 25 provided on the connecting plate 9 and the fixing piece 24, and with nuts 27 and 27. Therefore, the inflexible portion 14*b* of the back plate 14 is firmly mounted on the left and right backrest support rods 10 and 10.

By mounting the back plate 14 on the left and right backrest support rods 10 and 10 as described above, the tubular holding portions 22 and 22 are fitted to the upper ends of both of the backrest support rods 10, so that the upper ends of the backrest support rods 10 are prevented from moving forward. Therefore, when the backrest 7 is reclined, moment in a direction away from the back plate 14 is not applied to the fixed portion in the lower portion of the back plate 14. Therefore, it becomes less necessary to increase the fixing strength of the lower portion of the back plate 14.

Incidentally, in some cases, the through holes 25 of the fixing piece 24 may be formed as female screws and the nuts 27 may be omitted.

Upper portions of the backrest support rods 10 and the front surface of the inflexible portion 14*b* of the back plate 14 are covered by the front surface plate 28, which is mounted on the front portion of the inflexible portion 14*b*, which is made of hard synthetic resin in approximately the same shape as the inflexible portion, and which has large bending rigidity.

Figure 8:
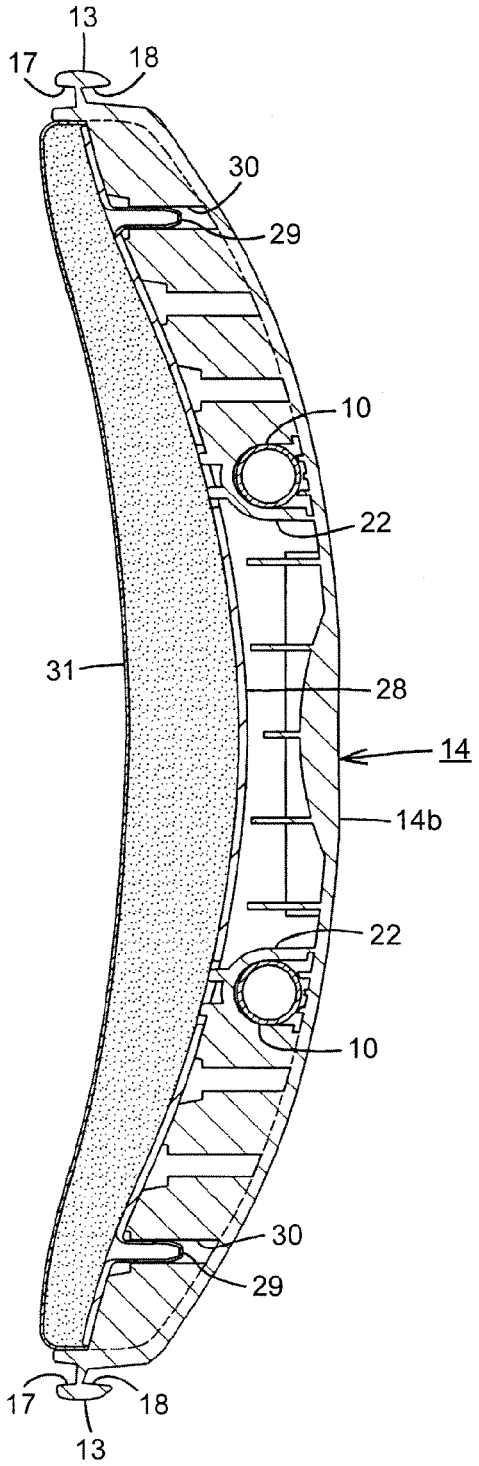
FIG. 8 is an enlarged transverse cross-sectional plan view taken along line VIII-VIII of FIG. 7.

The front surface plate 28 is, as illustrated in FIG. 8, fixedly attached so as to be aligned with the same plane as the front surface of the flexible portion 14*a* by press fitting four tubular protrusions 29, which protrude backward from the top, bottom, left, and right of the rear surface thereof, into appropriate four of fitting holes 30 (see FIG. 4) formed at the intersections of the grid-like ribs 21. Incidentally, an upper portion of the front surface plate 28, that is, a portion for supporting a sitting person around his or her lumbar is curved in a laid-V shape when viewed from the side (see FIG. 7).

The front surface of the front surface plate 28, the front surface of the flexible portion 14*a* of the back plate 14, and the rear surface of the flexible portion 14*a* of the back plate 14 are covered by a cushion material 31 that is folded in half.

As described above, according to the chair of the embodiment, the concave portion 16 that is opened downward is provided below the intermediate portion of the front surface of the back plate 14 in the up-down direction, and, the tubular holding portions 22 and 22, which protrude downward from the lower surface of the step portion 15 and which are opened downward, are fitted to the upper ends of the left and right backrest support rods 10 and 10 that are inserted in the concave portion 16. Therefore, it is possible to easily determine the position of the back plate 14 and temporarily hold the back plate 14, with respect to both of the backrest support rods 10.

Therefore, fixing operation of the lower portion of the back plate 14, that is, screwing operation between the fixing piece 24 protruding from the inflexible portion 14*b* and the connecting plate 9 connecting the left and right backrest support rods 10 and 10 can be made much easier.

Furthermore, the left and right tubular holding portions 22 and 22 are formed so as to be integrated with and continued to the step portion 15 and the front surface of the inflexible portion 14*b* of the back plate 14, and the bending strength in the front-back and the left-right directions is increased. Therefore, even by only fitting both of the holding portions 22 and 22 to the upper ends of the left and right backrest support rods 10 and 10, it becomes possible to stably hold the intermediate portion of the back plate 14 by the upper ends of the backrest support rods 10 and 10.

Therefore, it becomes not necessary to fix the intermediate portion of the back plate 14 to the upper ends of the backrest support rods 10 by a fixing means, such as screws, and, it becomes possible to fully ensure the mounting strength of the back plate 14 with respect to the backrest support rods 10 even by fixing only the lower portion of the back plate 14 to the connecting plate 9 of the backrest support rods 10 with screws. Therefore, it becomes not necessary to use a special connecting member or to fix the back plate with screws at two portions at the top and bottom as in the conventional technology. As a result, the number of components and costs can be reduced.

The upper half of the back plate 14 for supporting the back of a sitting person is used as the flexible portion 14*a*, a lower half including the front surface plate 28 for supporting the sitting person around and below the lumbar is used as the inflexible portion 14*b*, the upper half and the lower half of the back plate 14 are distinctly separated as an easy-to-bend portion and a hard-to-bend portion, the concave portion 16 formed below the intermediate portion of the back plate 14 is supported by the backrest support rods 10, and the flexible portion 14*a* and the inflexible portion 14*b* are continuously provided on the opposing surfaces of a pair of the left and right side rods 13 and 13, each having a laid-V shape when viewed from the side and having higher rigidity. Therefore, the flexible portion 14*a* can more easily bend backward in more upper portions, so that it becomes possible to comfortably support the back of a sitting person via the cushion material 31 and to comfortably support the lumbar of the sitting person due to the lumbar support effect by the inflexible portion 14*b* having the higher rigidity than that of the flexible portion and by the front surface plate 28 on the front surface of the inflexible portion.

The present invention is not limited to the above embodiment.

In the embodiment, the concave portion 16 is formed in the front surface of the back plate 14, and the holding portions 22 and 22 continued to the step portion 15, which is formed on the upper surface of the concave portion and which is recessed backward, are fitted to the upper ends of the backrest support rods 10 and 10. However, in contrast, a concave portion that is recessed forward and opened downward may be provided on the rear surface of the back plate 14, and holding portions as described above may be formed in a continuous manner on a step surface, which is formed on the upper surface of the concave portion and which is recessed forward, such that the holding portions are fitted to the upper ends of the backrest support rods 10. In this case, the front surface plate 28 is not needed, the lower half of the back plate 14 serves as the inflexible portion as it is, and a rear surface plate is fixedly attached to the rear surface of the concave portion that is recessed forward.

Furthermore, it may be possible to provide grid-like ribs protruding from the rear surface of the inflexible portion in the lower half in order to reinforce the lower half.

The present invention may be applied to a chair in which the cushion material 31 is not mounted on the backrest 7.

REFERENCE SIGNS LIST

1 CASTER
2 LEG ROD
3 LEG BODY
4 LEG COLUMN
5 SUPPORT BASE
5*a* COVER
6 ARMREST
7 BACKREST
8 SEAT
9 CONNECTING PLATE
10 BACKREST SUPPORT ROD
11 SHAFT
12 GAS SPRING
13 SIDE ROD
13*a* FOLDED PORTION
14 BACK PLATE
14*a* FLEXIBLE PORTION
14*b* INFLEXIBLE PORTION
15 STEP PORTION
16 CONCAVE PORTION
17 CONCAVE GROOVE
18 CONCAVE GROOVE
19 ELONGATED HOLE
20 RIB
21 RIB
22 HOLDING PORTION
23 RIB
24 FIXING PIECE
25 THROUGH HOLE
26 FIXING SCREW
27 NUT
28 FRONT SURFACE PLATE
29 TUBULAR PROTRUSION
30 FITTING HOLE
31 CUSHION MATERIAL

The invention claimed is:

1. A backrest mechanism for a chair, comprising:

a pair of left and right side rods, each having a folded portion in a laid-V shape in a side view at a portion for supporting a sitting person around his or her lumbar; and a back plate that connects opposing surfaces of the side rods, wherein an upper portion of the back plate above the folded portions serves as a flexible portion that is elastically deformable in a backward direction and that has smaller rigidity than the left and right side rods, and a lower portion of the back plate below the flexible portion serves as an inflexible portion that has greater rigidity than the flexible portion.

2. The backrest mechanism for a chair according to claim 1, wherein a center portion of the inflexible portion in a left-right direction is connected to a backrest support rod that stands upward at a rear of a seat.

3. The backrest mechanism for a chair according to claim 1, wherein a plurality of elongated holes elongated in an up-down direction and arranged in up-down and left-right directions are provided in the flexible portion.

4. The backrest mechanism for a chair according to claim 1, wherein the flexible portion and the inflexible portion are connected to the opposing surfaces of the left and right side rods such that the flexible portion is located anteriorly relative to the inflexible portion, a lower end of the flexible portion and an upper end of the inflexible portion are continued via a step portion, and a grid rib is arranged so as to protrude from a front surface of the inflexible portion and so as to be continued to the step portion.

5. The backrest mechanism for a chair according to claim 4, wherein a front surface plate is attached to the front surface of the inflexible portion across the grid like grid rib.

* * * * *